US009601065B2

(12) United States Patent
Kondo et al.

(10) Patent No.: US 9,601,065 B2
(45) Date of Patent: Mar. 21, 2017

(54) DISPLAY PANEL DRIVER SETTING METHOD, DISPLAY PANEL DRIVER, AND DISPLAY APPARATUS INCLUDING THE SAME

(71) Applicant: LAPIS Semiconductor Co., Ltd., Yokohama (JP)

(72) Inventors: Hironori Kondo, Yokohama (JP); Atsushi Yusa, Yokohama (JP)

(73) Assignee: LAPIS SEMICONDUCTOR CO., LTD., Yokohama (JP)

( * ) Notice: Subject to any disclaimer, the term of this patent is extended or adjusted under 35 U.S.C. 154(b) by 447 days.

(21) Appl. No.: 14/061,205

(22) Filed: Oct. 23, 2013

(65) Prior Publication Data

US 2014/0118371 A1 May 1, 2014

(30) Foreign Application Priority Data

Oct. 26, 2012 (JP) ..... 2012-236861

(51) Int. Cl.
*G09G 3/36* (2006.01)

(52) U.S. Cl.
CPC ..... *G09G 3/36* (2013.01); *G09G 3/3688* (2013.01)

(58) Field of Classification Search
None
See application file for complete search history.

(56) References Cited

U.S. PATENT DOCUMENTS

2004/0227744 A1* 11/2004 Toriumi ..... G09G 3/3648 345/204
2005/0043823 A1* 2/2005 Morita ..... G09G 3/3688 700/11
2009/0027595 A1* 1/2009 Takahashi ..... G09G 3/3611 349/73
2012/0235964 A1* 9/2012 Kim ..... G09G 3/20 345/204
2013/0076703 A1* 3/2013 Baek ..... G09G 3/2092 345/204
2013/0222713 A1* 8/2013 Park ..... G02B 27/2264 349/15

FOREIGN PATENT DOCUMENTS

JP 2002-108311 A 4/2002
JP 2005-038346 A 2/2005
JP 2006-251772 A 9/2006
JP 2006-284924 A 10/2006
JP 2007-079077 A 3/2007
JP 2009-032714 A 2/2009
JP 2010-190932 A 9/2010

* cited by examiner

*Primary Examiner* — Ryan M Gray
(74) *Attorney, Agent, or Firm* — Rabin & Berdo, P.C.

(57) ABSTRACT

When a plurality of display panel drivers is set to a state in conformity to given specifications, setting data indicative of details of the setting is stored in a memory. One of the display panel drivers supplies a first signal indicating that the setting data is in a readout condition to the memory and other display panel drivers. In response to the first signal, the memory reads and provides the setting data on the first line. The one display panel driver fetches the setting data on the first line to perform the setting based on the setting data. The other display panel drivers fetch the setting data from the first line in response to the first signal to perform the setting based on the setting data.

20 Claims, 8 Drawing Sheets

DISPLAY PANEL DRIVER SETTING METHOD, DISPLAY PANEL DRIVER, AND DISPLAY APPARATUS INCLUDING THE SAME

TECHNICAL FIELD

The present invention relates to a driver setting method for a display panel. The display panel is driven by a plurality of display panel drivers in accordance with a video signal. The present invention also relates to such display panel driver(s), and a display apparatus including such display panel drivers.

DESCRIPTION OF THE RELATED ART

A display panel such as a plasma display panel, a liquid crystal panel, and an organic EL (electro luminescence) panel has a plurality of source drivers that are configured to supply a gradation voltage corresponding to a video signal to a plurality of source lines formed on the display panel.

A driving method of the source drivers is decided based on a driving method of the display panel. In general, therefore, a timing controller is separately disposed that controls operation timing of the source drivers and other components.

Japanese Patent Application Publication (Kokai) No. 2007-079077 discloses a display panel that is equipped with an EEPROM (electrically erasable programmable read-only memory) configured to store system interface information. The system interface information is set in the timing controller in accordance with specifications of a system having the display panel and a plurality of the source drivers (see FIG. 1 of Japanese Patent Application Publication No. 2007-079077).

Communication between the timing controller and the EEPROM may be established by disposing a path for direct communication if there is one-to-one relationship between the timing controller and the EEPROM. Therefore, an integrated circuit having a source driver and a timing controller integrally formed is being developed. One example of such integrated circuit is disclosed in Japanese Patent Application Publication No. 2010-190932. This integrated circuit requires setting from the EEPROM for each source driver equipped with a timing controller. Also, the communication must be performed by using a plurality of dedicated lines between the respective source drivers and the EEPROM or by using a common communication line between all the source drivers and the EEPROM. Setting should be carried out at different timing when the common communication line is used.

A technique of allowing communication between source drivers is also devised in order to simplify the communication between the source drivers and the EEPROM. One example of such technology is shown in FIG. 1 of Japanese Patent Application Publication No. 2009-32714.

In a display panel shown in Japanese Patent Application Publication No. 2009-32714, only one source driver 6*a* among a plurality of source drivers 6 is connected to an EEPROM 21 and the source driver 6*a* acts as a base point to fetch system interface information that has been read from the EEPROM 21. The source driver 6*a* sets itself based on the system interface information while relaying and supplying the system interface information via a first ITO (indium tin oxide) wiring pattern 12 to another cascade-connected source driver (i.e., downstream source driver) 6. The downstream source driver 6 sets itself based on the system interface information received via the first ITO wiring pattern 12 while relaying and supplying the system interface information via a second ITO wiring pattern 12 to yet another cascade-connected source driver (i.e., next downstream source driver) 6. With such a configuration, the system interface information read from the EEPROM 21 is supplied to the downstream source driver(s) 6 via the source driver 6*a* acting as the start point, and the setting is performed in the respective downstream source driver(s) 6 based on the system interface information.

In the above-described display panel, setting information read from the EEPROM is once fetched by the source driver acting as a start point and is relayed and supplied via cascade-connected wiring to other source drivers. Therefore, as the number of stages of source drivers cascade-connected in series becomes larger, it takes a longer time until the setting information reach all the source drivers. This results in a longer waiting time after start of a setting process until start of an actual display operation.

SUMMARY OF THE INVENTION

An object of the present invention is to provide a method for setting a plurality of display panel drivers that can quickly set the display panel drivers in accordance with given specifications.

Another object of the present invention is to provide a display panel driver that can be set fast in accordance with given specifications.

Still another object of the present invention is to provide a display apparatus including such display panel drivers.

According to a first aspect of the present invention, there is provided an initial setting method for a plurality of display panel drivers in accordance with specifications based on setting data stored in a memory. The display panel drivers are configured to drive a display panel that displays an image corresponding to a video signal. The method includes causing one of the display panel drivers to supply a first signal indicating that the setting data is in a readout condition to the memory and to the remaining display panel driver(s). The method also includes causing the one display panel driver to fetch the setting data, which is read from the memory onto a first line, to perform setting based on the setting data. The method also includes causing the remaining display panel driver(s) to fetch the setting data from the first line in response to the first signal supplied from the one display panel driver to perform the setting based on the setting data.

According to a second aspect of the present invention, there is provided a display panel driver that is set in accordance with setting data stored in a memory. The display panel driver includes a first circuit for outputting via a bidirectional terminal a first signal indicating that the setting data is in a condition to be read. The display panel driver also includes a fetch control circuit for generating a fetch enable signal in response to the first signal or an external signal received from the outside via the bidirectional terminal. The external signal is equivalent to the first signal. The display panel driver also includes a register for fetching the setting data, which is read from the memory, in response to the fetch enable signal.

According to a third aspect of the present invention, there is provided a display apparatus that includes a display panel for displaying an image corresponding to a video signal. The display apparatus also includes a first display panel driver and a second display panel driver that operate in combination to drive the display panel. The display apparatus also includes a memory for storing setting data. The first display panel driver includes a first circuit for outputting via a first bidirectional terminal a first signal indicating that the setting data is in a condition to be read. The first display panel driver also includes a first fetch control circuit for generating a fetch enable signal in response to the first signal. The first display panel driver also includes a first register for receiving the setting data via an input terminal. The first register is configured to fetch the setting data in response to the fetch enable signal. The second display panel driver includes a second fetch control circuit for generating a fetch enable signal in response to the first signal received at a second bidirectional terminal from the first bidirectional terminal. The second display panel driver also includes a second register for receiving via an input terminal the setting data which is read from the memory. The second register is configured to fetch the setting data in response to the fetch enable signal. An output terminal of the memory is connected through a first line to the input terminals of the first and second display panel drivers. The first bidirectional terminal of the first display panel driver is connected through a second line to the second bidirectional terminal of the second display panel driver and to the memory.

When a plurality of display panel drivers for a single display panel should be set to a desired initial condition in conformity to the given specifications, setting data indicative of details of the setting is stored in the memory. One of the display panel drivers supplies a first signal indicating that the setting data is in a readout condition to the memory and the other display panel driver(s). In response to the first signal, the memory reads and supplies the setting data onto the first line. The above-mentioned one display panel driver fetches the setting data from the first line to perform the setting based on the setting data. The other display panel drivers fetch the setting data from the first line in response to the first signal received from the above-mentioned one display panel driver to perform the setting based on the setting data.

In response to the first signal issued from the one display panel driver, the setting data is read from the memory onto the first line, and the setting data on the first line is concurrently fetched by the one display panel driver and the other display panel drivers. Therefore, the setting operation can be completed faster than a configuration that is designed to sequentially relay the setting data, which is read from the memory, to a plurality of display panel drivers via cascaded wiring.

These and other objects, aspects and advantages of the present invention will become apparent to those skilled in the art from the following detailed description when read and understood in conjunction with the appended claims and drawings.

DETAILED DESCRIPTION OF THE INVENTION

Figure 1:
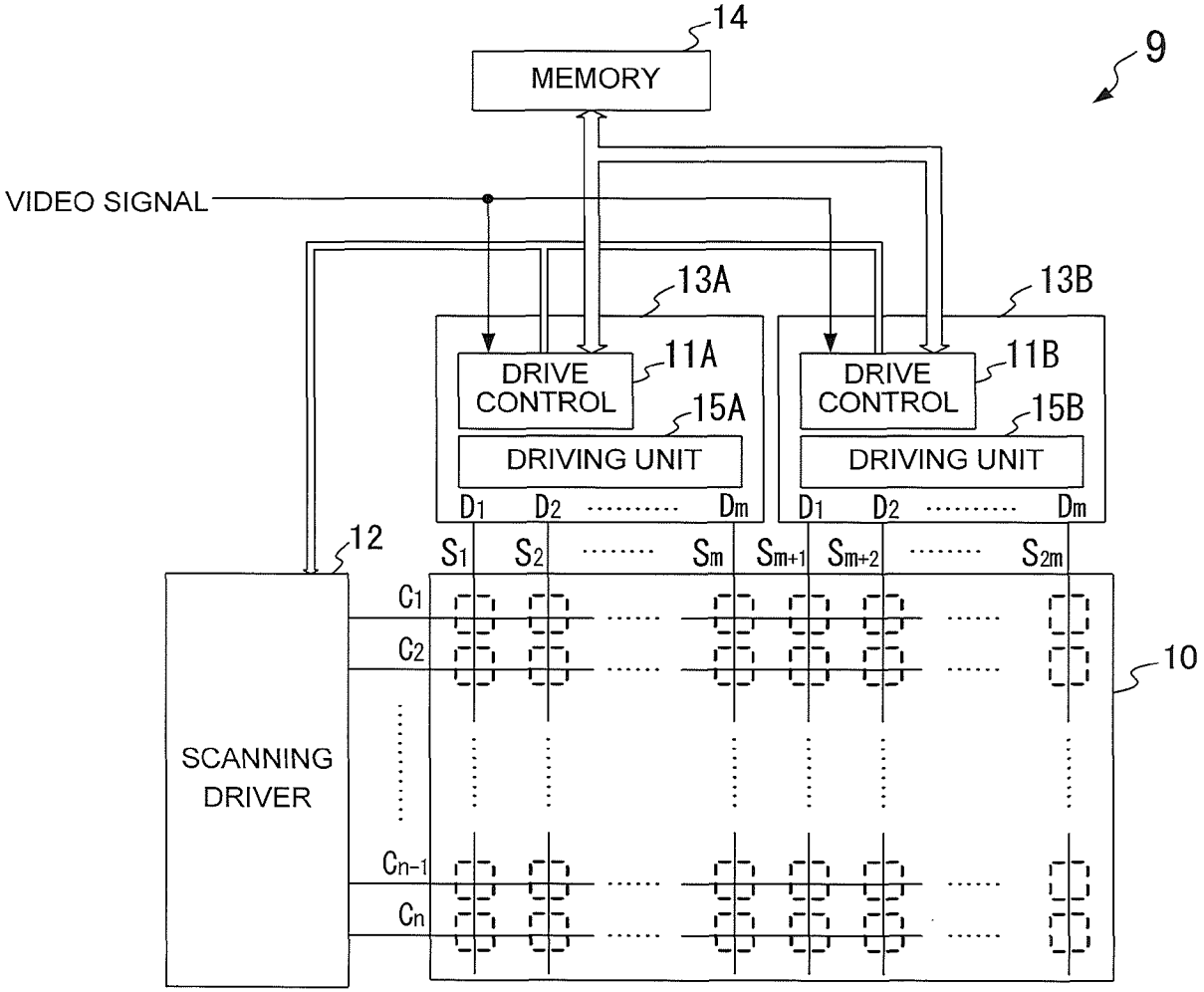
FIG. 1 is a block diagram of a schematic configuration of a display apparatus according to an exemplary embodiment of the present invention.

Referring to FIG. 1, a general configuration of a display apparatus 9 that includes a plurality of display panel drivers 13A and 13B according to one embodiment of the present invention will be described.

As depicted in FIG. 1, the display apparatus 9 includes a display panel 10, a drive control unit 11, a scanning driver 12, source drivers 13A and 13B, and a setting data memory 14. A drive control unit 11A and a driving unit 15A are provided in the first source driver 13A. Another drive control unit 11B and another driving unit 15B are provided in the second source driver 13B. It should be noted that although the scanning driver 12 is separate from the source drivers 13A and 13B in FIG. 1, the scanning driver 12 may be provided in the source drivers 13A and/or 13B.

The display panel 10 is configured to display a two-dimensional image. The display panel 10 may include a plasma display panel, a liquid crystal panel, or an organic EL (electroluminescence) panel. The display panel 10 has n scanning lines $C_1$ to $C_n$ (n is an integer equal to or greater than two) extending in parallel in a horizontal direction of a two-dimensional screen and 2m source lines $S_1$ to $S_{2m}$ (m is an integer equal to or greater than one) extending in parallel in a vertical direction of the two-dimensional screen. Display cells, which function as pixels, are formed at intersection potions of the scanning lines and the source lines (areas surrounded by the broken lines in FIG. 1).

The drive control units 11A and 11B generate a scanning control signal for sequentially applying scanning pulses to the scanning lines $C_1$ to $C_n$ in response to an input video signal. The drive control units 11A and 11B supply the scanning control signal to the scanning driver 12. The scanning driver 12 generates the scanning pulses at timing corresponding to the scanning control signal and sends the scanning pulses to the scanning lines $C_1$ to $C_n$ of the display panel 10 selectively in an appropriate order.

The drive control units 11A and 11B generate various control signals such as a scan clock signal SCLK and a start pulse signal ST (described later) in synchronization with the input video signal, and sends these control signals to the driving units 15A and 15B in the source drivers 13A and 13B respectively. The drive control units 11A and 11B also generate pixel data PD indicative of a luminance level of each pixel based on the input video signal and supply the pixel data PD to each of the driving units 15A and 15B in serial form for one display line at a time (i.e., 2m pixel data PD at a time). Therefore, the drive control unit 11A generates and sequentially supplies pixel data $PD_1$, $PD_2$, $PD_3$, . . . , and $PD_m$ (i.e., a series of the pixel data PD) corresponding to a first half of one display line based on the input video signal to the driving unit 15A. The drive control unit 11B generates and sequentially supplies pixel data $PD_{m+1}$, $PD_{m+2}$, $PD_{m+3}$, . . . , and $PD_{2m}$ (i.e., another series of the pixel data PD) corresponding to a second half of the one display line based on the input video signal to the driving unit 15B.

The source drivers 13A and 13B, each acting as a display panel driver, have the same internal configuration and are built on different semiconductor IC chips.

The driving unit 15A of the first source driver 13A has m latches (described later) for sequentially fetching the pixel data $PD_1$ to $PD_m$ out of the pixel data $PD_1$ to $PD_{2m}$. The driving unit 15A generates drive pulses $GP_1$ to $GP_m$. The drive pulses $GP_1$ to $GP_m$ have respective peak values that are gradation voltages corresponding to luminance levels indicated by the respective pixel data $PD_1$ to $PD_m$. The drive unit 15A sends the drive pulses $GP_1$ to $GP_m$ via output terminals $D_1$ to $D_m$ to the outside of the chip. The output terminals $D_1$ to $D_m$ of the first source driver 13A are connected to the source lines $S_1$ to $S_m$ of the display panel 10, respectively. Therefore, the drive pulses $GP_1$ to $GP_m$ generated in the first source driver 13A are applied via the output terminals $D_1$ to $D_m$ to the source lines $S_1$ to $S_m$, respectively.

The driving unit 15B of the second source driver 13B has m latches (described later) for sequentially fetching the pixel data $PD_{m+1}$ to $PD_{2m}$ out of the pixel data $PD_1$ to $PD_{2m}$. The driving unit 15B generates drive pulses $GP_{m+1}$ to $GP_{2m}$ having peak values that are gradation voltages corresponding to luminance levels indicated by the pixel data $PD_{m+1}$ to $PD_{2m}$. The drive unit 15B sends the drive pulses $GP_{m+1}$ to $GP_{2m}$ via output terminals $D_1$ to $D_m$ to the outside of the chip. The output terminals $D_1$ to $D_m$ of the second source driver 13B are connected to the source lines $S_{m+1}$ to $S_{2m}$ of the display panel 10, respectively. Therefore, the drive pulses $GP_{m+1}$ to $GP_{2m}$ generated in the second source driver 13B are applied via the output terminals $D_1$ to $D_m$ to the source lines $S_{m+1}$ to $S_{2m}$, respectively.

The setting data memory 14 is a non-volatile memory such as an EEPROM, and stores head latch specifying data $DL_H$, tail latch specifying data $DL_T$, and scan direction specifying data $D_{SCN}$ in advance as setting data for the source drivers 13A and 13B, i.e., setting data for deciding operations in conformity to (or suited for) system specifications. The head latch specifying data $DL_H$ is indicative of the number of that latch which is responsible for fetching the pixel data PD at the head of a display line, in a data latch unit provided in the source drivers 13A and 13B. The tail latch specifying data $DL_T$ is indicative of the number of that latch which is responsible for fetching the pixel data PD at the tail of the display line in the data latch unit. The scan direction specifying data $D_{SCN}$ specifies the scan direction (either the ascending order of the latch number or the descending order), i.e., whether the latches, which fetch pixel data pieces, in the latch units are sequentially activated in the ascending order or the descending order. For example, if the pixel data pieces are fetched by the latches in the ascending order of the latch number in the latch unit, the scan direction specifying data $D_{SCN}$ of a logic level 0 is stored in the setting data memory 14. If the pixel data pieces are fetched by the latches in the descending order of the latch number in the data latch unit, then the scan direction specifying data $D_{SCN}$ of a logic level 1 is stored in the setting data memory 14.

The setting data memory 14 reads the head latch specifying data $DL_H$, the tail latch specifying data $DL_T$, and the scan direction specifying data $D_{SCN}$ corresponding to each of the source drivers 13A and 13B in serial form in response to a memory access signal BDAO (described later) received from the source driver 13A. In the meantime, the setting data memory 14 supplies a setting data signal BDAI indicative of the data $DL_H$, $DL_T$, and $D_{SCN}$ in serial form to the source drivers 13A and 13B. The setting data memory 14 writes the head latch specifying data $DL_H$, the tail latch specifying data $DL_T$, and the scan direction specifying data $D_{SCN}$ to be set in response to the memory access signal BDAO received from the source driver 13A.

Figure 2:
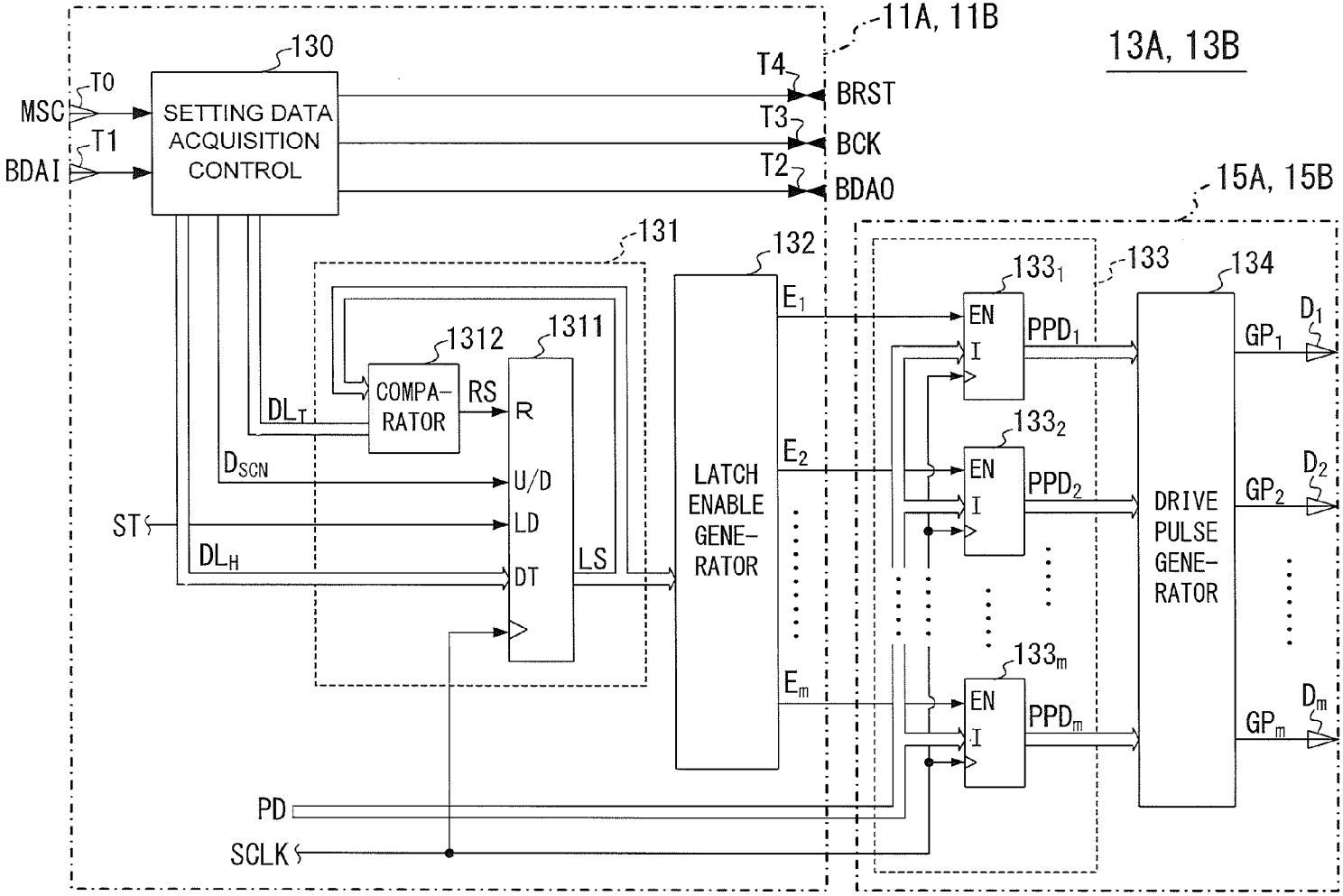
FIG. 2 is a block diagram of an internal configuration of source drivers (i.e., display panel drivers) shown in FIG. 1.

Referring now to FIG. 2, the internal configuration of the source drivers 13A and 13B will be described. As mentioned earlier, the source drivers 13A and 13B have the same internal configuration.

As depicted in FIG. 2, each of the source drivers 13A and 13B includes a setting data acquisition control unit 130, a latch selection counter 131, a latch enable generating unit 132, a data latch unit 133, and a drive pulse output unit 134.

The setting data acquisition control unit 130 fetches the setting data signal BDAI, which is read from the setting data memory 14, via an input terminal T1 disposed in the source driver 13A, 13B, and retains the setting data signal BDAI. The setting data acquisition control unit 130 extracts and reads the head latch specifying data $DL_H$, the tail latch specifying data $DL_T$, and the scan direction specifying data $D_{SCN}$ from the setting data signal BDAI and supplies these data to the latch selection counter 131.

In this embodiment, one of the two source drivers 13A and 13*b* serves as a master driver and the other serves as a slave driver. If "master" is indicated by a master/slave specifying signal MSC received from the outside via an input terminal T0 disposed in the source driver 13A (or 13B), the setting data acquisition control unit 130 generates the memory access signal BDAO (described later) for accessing the setting data memory 14 at predetermined timing after power-on. The setting data acquisition control unit 130 then sends the memory access signal BDAO to the outside of the chip via a bidirectional terminal T2 disposed in the source driver 13A (or 13B). On the other hand, if the master/slave specifying signal MSC indicates "slave," the setting data acquisition control unit 130 fetches (takes) the memory access signal BDAO via the bidirectional terminal T2 from the outside of the chip.

When the master/slave specifying signal MSC indicates "master," the setting data acquisition control unit 130 also generates a chip select signal BRST and a clock signal BCK (described later) at predetermined timing after power-on and sends these signals to the outside of the chip via bidirectional terminals T3 and T4 disposed in the source driver 13A, 13B. If the master/slave specifying signal MSC indicates "slave," the setting data acquisition control unit 130 fetches the signals BRST and BCK via the bidirectional terminals T3 and T4 from the outside of the chip.

The latch selection counter 131 has an up-down counter 1311 and a comparator 1312.

The up-down counter 1311 fetches the latch number indicated by the head latch specifying data $DL_H$ as a count initial value in response to the start pulse signal ST received from the drive control unit 11. If the scan direction specifying data $D_{SCN}$ indicates the ascending order of the latch number, the up-down counter 1311 operates as an up counter and counts up (increments) the value thereof from the count initial value upon each pulse of the scan clock signal SCLK. On the other hand, if the scan direction specifying data $D_{SCN}$ indicates the descending order of the latch number, the up-down counter 1311 operates as a down counter and counts down the value thereof from the count initial value upon each pulse of the scan clock signal SCLK. The up-down counter 1311 supplies the current count value as a latch selection value LS to the comparator 1312. Only when a value of the latch number indicated by the tail latch specifying data $DL_T$ is equal to the latch selection value LS, the comparator 1312 generates and supplies to the up-down counter 1311 a reset signal RS resetting the count value to zero. In response to the reset signal RS, the up-down counter 1311 resets the current count value to zero and terminates the counting operation.

As described above, the up-down counter 1311 first fetches as the count initial value the latch number indicated by the head latch specifying data $DL_H$ in response to the start pulse signal ST. The up-down counter 1311 then supplies the count value, which is acquired by counting up or down the count initial value in accordance with the scan direction specifying data $D_{SCN}$, as the latch selection value LS to the latch enable generating unit 132 on the next stage.

The latch enable generating unit 132 has a decoder for generating latch enable signals $E_1$ to $E_m$ such that only one of the latch enable signals $E_1$ to $E_m$ is set to the logic level 1 indicative of latch enable while the other signals are set to the logic level 0 indicative latch disable based on the latch selection value LS.

For example, if the latch selection value LS indicates the latch number "1," the latch enable generating unit 132 generates the latch enable signals $E_1$ to $E_m$ such that only the signal $E_1$ among the latch enable signals $E_1$ to $E_m$ is set to the logic level 1 while the other signals are all set to the logic level 0. If the latch selection value LS indicates the latch number "2," the latch enable generating unit 132 generates the latch enable signals $E_1$ to $E_m$ such that only the signal $E_2$ among the latch enable signals $E_1$ to $E_m$ is set to the logic level 1 while the other signals are all set to the logic level 0. If the latch selection value LS indicates the latch number "3," the latch enable generating unit 132 generates the latch enable signals $E_1$ to $E_m$ such that only the signal $E_3$ of the latch enable signals $E_1$ to $E_m$ is set to the logic level 1 while the other signals are all set to the logic level 0. If the latch selection value LS indicates the latch number "m," the latch enable generating unit 132 generates the latch enable signals $E_1$ to $E_m$ such that only the signal $E_m$ of the latch enable signals $E_1$ to $E_m$ is set to the logic level 1 while the other signals are all set to the logic level 0.

The latch enable generating unit 132 supplies the latch enable signals $E_1$ to $E_m$ to the data latch unit 133.

The data latch unit 133 includes m latches $\mathbf{133}_1$ to $\mathbf{133}_m$ assigned with the latch numbers "1" to "m" respectively. Each latch $\mathbf{133}_i$ (i=1 to m) has an enable terminal EN supplied with the latch enable signal $E_i$. Data input terminals I of the respective latches $\mathbf{133}_1$ to $\mathbf{133}_m$ are supplied with the pixel data PD in common, and clock input terminals of the respective latches $\mathbf{133}_1$ to $\mathbf{133}_m$ are supplied with the scan clock signal SCLK in common. In response to the scan clock signal SCLK, the pixel data PD is captured and retained by only that one of the latches 133 out of the latches $\mathbf{133}_1$ to $\mathbf{133}_m$ which receives the latch enable signal E set to the logic level 1 at its enable terminal EN.

With the above-described configuration, the latches $\mathbf{133}_1$ to $\mathbf{133}_m$ individually fetch and retain the pixel data PD received from the drive control unit 11 in accordance with the latch enable signals $E_1$ to $E_m$ received from the latch enable generating unit 132. The latches $\mathbf{133}_1$ to $\mathbf{133}_m$ supply the pixel data as pixel data $PPD_1$ to $PPD_m$ to the drive pulse output unit 134.

The drive pulse output unit 134 individually converts each of the pixel data $PPD_1$ to $PPD_m$ into the drive pulse GP having a peak voltage corresponding to a luminance level indicated by the pixel data PPD concerned. Then, the drive pulse output unit 134 outputs the drive pulses $GP_1$ to $GP_m$ corresponding to the respective pixel data $PPD_1$ to $PPD_m$ via the output terminals $D_1$ to $D_m$.

The operations of the latch selection counter 131, the latch enable generating unit 132, and the data latch unit 133 will be described.

If pixel data is fetched by the latches $\mathbf{133}_1$ to $\mathbf{133}_m$, which are associated with the output terminals $D_1$ to $D_m$ respectively, in ascending order of the latch number, i.e., in the order of the latches $\mathbf{133}_1$, $\mathbf{133}_2$, $\mathbf{133}_3$, . . . , $\mathbf{133}_{m-1}$, and $\mathbf{133}_m$, then the head latch specifying data $DL_H$, the tail latch specifying data $DL_T$, and the scan direction specifying data $D_{SCN}$ are written into the setting data memory 14 in advance as follows.

$DL_H$: "1"
$DL_T$: "m"
$D_{SCN}$: "0"

In other words, the head latch specifying data $DL_H$ that indicates the latch number "1" of the latch responsible for fetching the pixel data piece at the head of the display line is written in the setting data memory 14. Likewise, the tail latch specifying data $DL_T$ that indicates the latch number "m" of the latch responsible for fetching the pixel data piece at the tail of the display line is written in the setting data memory 14. The scan direction specifying data $D_{SCN}$ at the logic level 0 that indicates the pixel data pieces should be fetched in the ascending order of the latch number is also written in the setting data memory 14.

Figure 3:
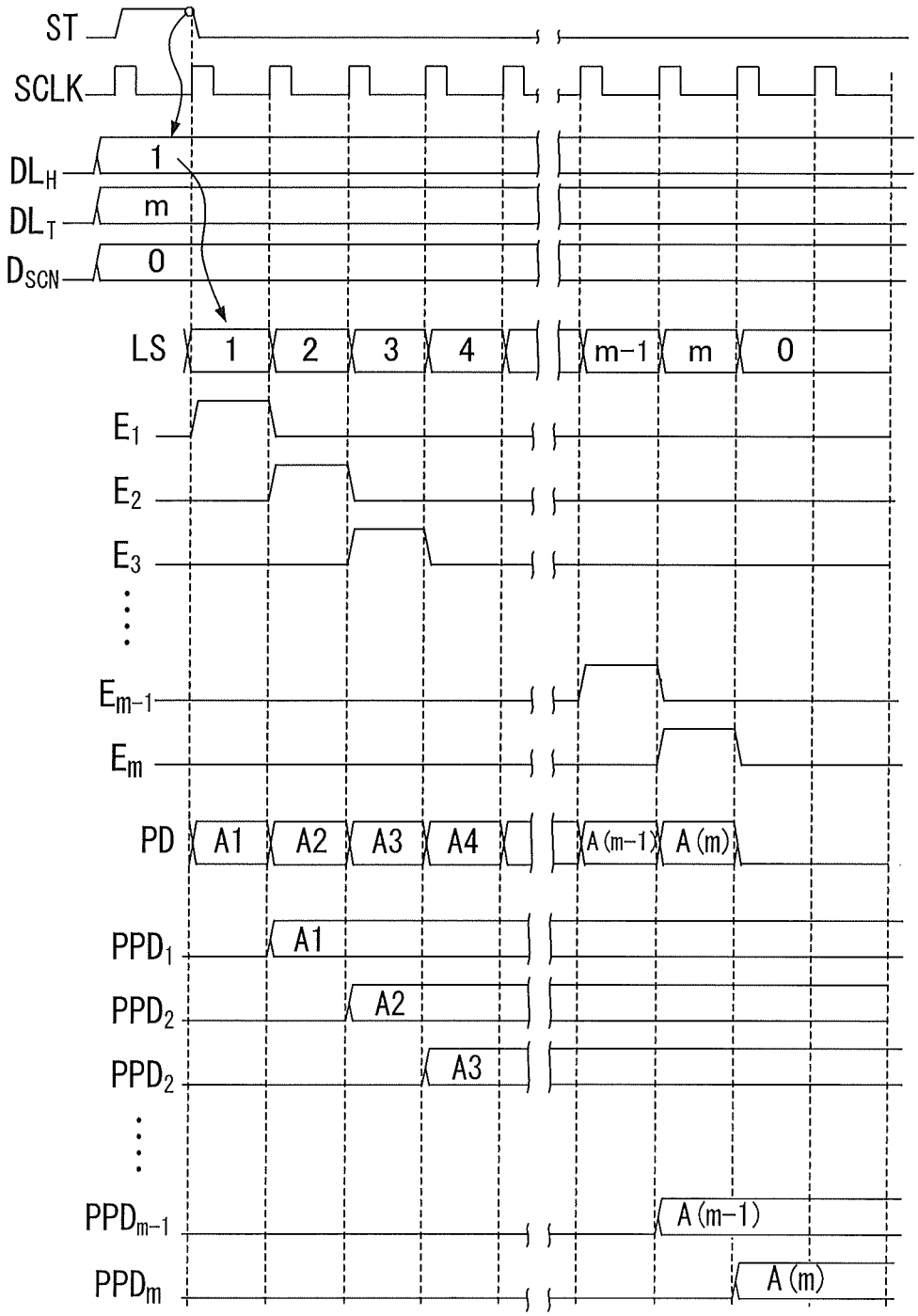
FIG. 3 is a time chart of an exemplary internal operation of the source drivers when pixel data is fetched in ascending order of the latch number.

As a result, as depicted in FIG. 3, the up-down counter 1311 fetches the value "1" indicated by the head latch specifying data $DL_H$ as the count initial value in response to the start pulse signal ST and supplies the value "1" as the latch selection value LS to the latch enable generating unit 132. The latch enable generating unit 132 supplies the latch enable signal $E_1$ of the logic level 1 to the latch $\mathbf{133}_1$ as depicted in FIG. 3 in response to the value "1" indicated by the latch selection value LS. In the meantime, the latch $\mathbf{133}_1$ fetches the value of the pixel data PD and outputs the value as the pixel data $PPD_1$. Since the scan direction specifying data $D_{SCN}$ is "0," the up-down counter 1311 operates as an up counter. Therefore, the count value of the up-down counter 1311, i.e., the latch selection value LS, is increased by "1" as depicted in FIG. 3 for each rising edge of the scan clock signal SCLK. As a result, the latch enable generating unit 132 sequentially supplies the latch enable signals $E_2$, $E_3$, . . . $E_{m-1}$, and $E_m$, which are set to the logic level 1, to the latches $\mathbf{133}_2$, $\mathbf{133}_3$, $\mathbf{133}_4$, . . . , $\mathbf{133}_{m-1}$, and $\mathbf{133}_m$ respectively, as depicted in FIG. 3, in accordance with the value of the latch selection value LS. The latches $\mathbf{133}_2$ to $\mathbf{133}_m$ sequentially fetch the values of the pixel data PD at the timing of the latch enable signals $E_2$ to $E_m$ received respectively as depicted in FIG. 3 and output the pixel data values as the pixel data $PPD_2$ to $PPD_m$. When the count value of the up-down counter 1311 becomes equal to the value "m" indicated by the tail latch specifying data $DL_T$, the comparator 1312 generates the reset signal RS to reset the count value of the up-down counter 1311, i.e., the latch selection value LS, to "0 (zero)." Therefore, after the latch enable signal $E_m$ of the logic level 1 is supplied to the latch $\mathbf{133}_m$, latch enable signals $E_{m+1}$ to $E_k$ of the logic level 1 are not generated and the fetch operation of the latches $\mathbf{133}_{m+1}$ to $\mathbf{133}_k$ is not performed.

On the other hand, if pixel data is fetched by the latches $\mathbf{133}_1$ to $\mathbf{133}_m$ in the descending order of the latch number, i.e., in the order of the latches $\mathbf{133}_m$, $\mathbf{133}_{m-1}$, . . . , $\mathbf{133}_3$, $\mathbf{133}_2$, and $\mathbf{133}_1$, then the head latch specifying data $DL_H$, the tail latch specifying data $DL_T$, and the scan direction specifying data $D_{SCN}$ are written into the setting data memory 14 in advance as shown below.

$DL_H$: "m"
$DL_T$: "1"
$D_{SCN}$: "1"

In other words, the head latch specifying data $DL_H$ that indicates the latch number "m" of the latch responsible for fetching the pixel data piece at the head of the display line is written in the setting data memory 14, and the tail latch specifying data $DL_T$ that indicates the latch number "1" of the latch responsible for fetching the pixel data piece at the tail of the display line is rewritten in the setting data memory 14. The scan direction specifying data $D_{SCN}$ of logic level 1 that indicates the fetching order (descending order of the latch number) of the pixel data pieces is also rewritten in the setting data memory 14.

Figure 4:
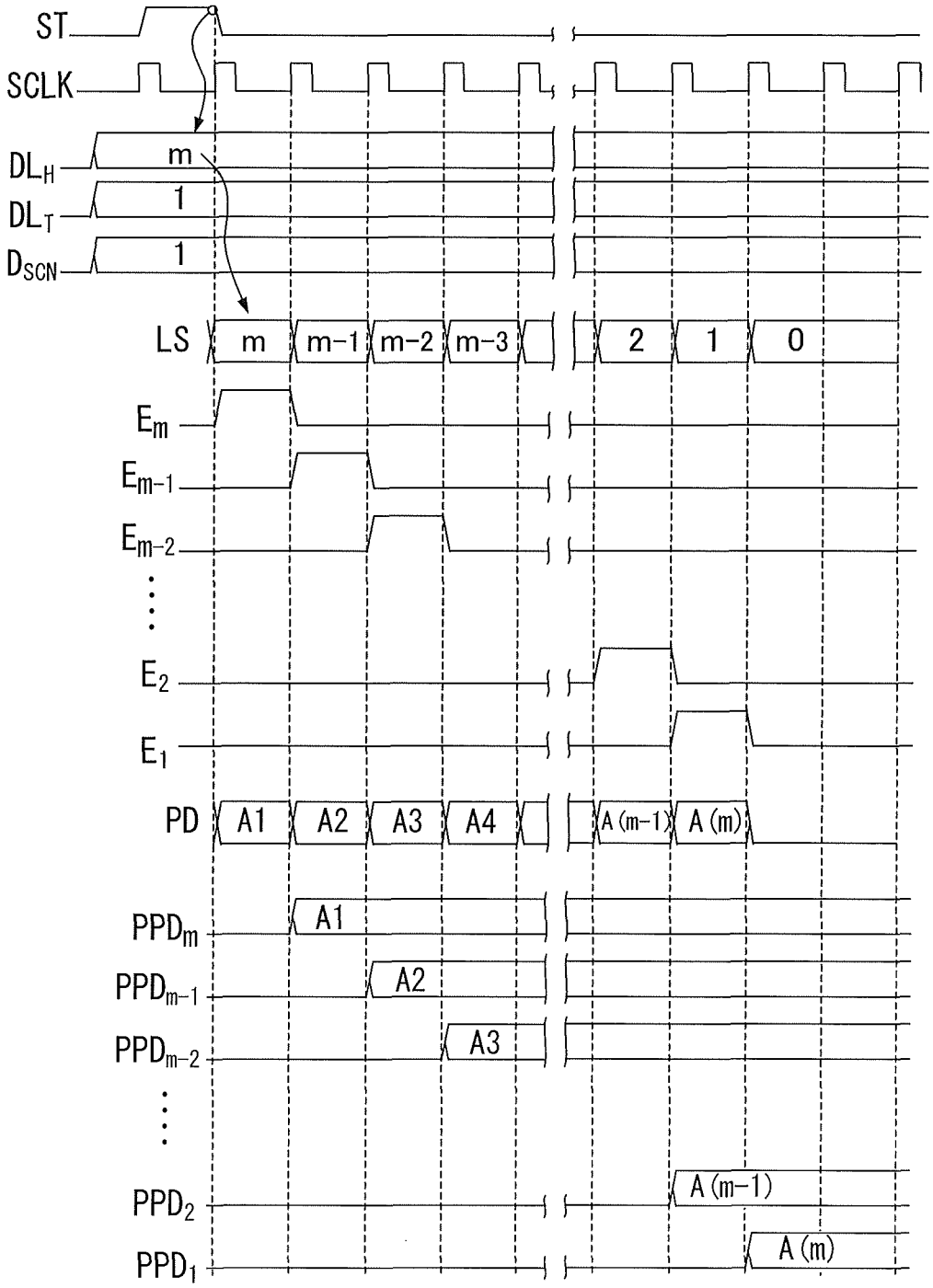
FIG. 4 is a time chart of an exemplary internal operation of the source drivers when the pixel data is fetched in descending order of the latch number.

As a result, as depicted in FIG. 4, the up-down counter 1311 fetches the value "m" indicated by the head latch specifying data $DL_H$ as the count initial value in response to the start pulse signal ST and supplies the value as the latch selection value LS to the latch enable generating unit 132. The latch enable generating unit 132 supplies the latch enable signal $E_m$ of the logic level 1 to the latch $\mathbf{133}_m$ as depicted in FIG. 4 in response to the value "m" indicated by the latch selection value LS. The latch $\mathbf{133}_m$ fetches the value of the pixel data PD and outputs the value as the pixel data $PPD_m$. Since the scan direction specifying data $D_{SCN}$ is "1," the up-down counter 1311 operates as a down counter. Therefore, the count value of the up-down counter 1311, i.e., the latch selection value LS, is decreased by "1" as depicted in FIG. 4 for each rising edge of the scan clock signal SCLK. As a result, the latch enable generating unit 132 sequentially supplies the latch enable signals $E_m$, $E_{m-1}$, . . . $E_2$, and $E_1$, which are at the logic level 1, to the latches $\mathbf{133}_m$, $\mathbf{133}_{m-1}$, . . . , $\mathbf{133}_2$, and $\mathbf{133}_1$ respectively as depicted in FIG. 4 in accordance with the value of the latch selection value LS. The latches $\mathbf{133}_{m-1}$ to $\mathbf{133}_1$ sequentially fetch the values of the pixel data PD at the timing of the latch enable signals $E_{m-1}$ to $E_1$ received as depicted in FIG. 4, and output the values as the pixel data $PPD_{m-1}$ to $PPD_1$. When the count value of the up-down counter 1311 becomes equal to the value "1" indicated by the tail latch specifying data $DL_T$, the comparator 1312 generates the reset signal RS to reset the count value of the up-down counter 1311, i.e., the latch selection value LS, to "0."

In this manner, the data latch unit 133 sequentially fetches the pixel data PD from the head latch to the tail latch along the scan direction of the pixel data decided by the setting data ($DL_H$, $DL_T$, and $DL_{SCN}$) stored in the setting data memory 14.

The fetch operation of the setting data ($DL_H$, $DL_T$, and $DL_{SCN}$) from the setting data memory 14 by the setting data acquisition control unit 130 will be described.

Figure 5:
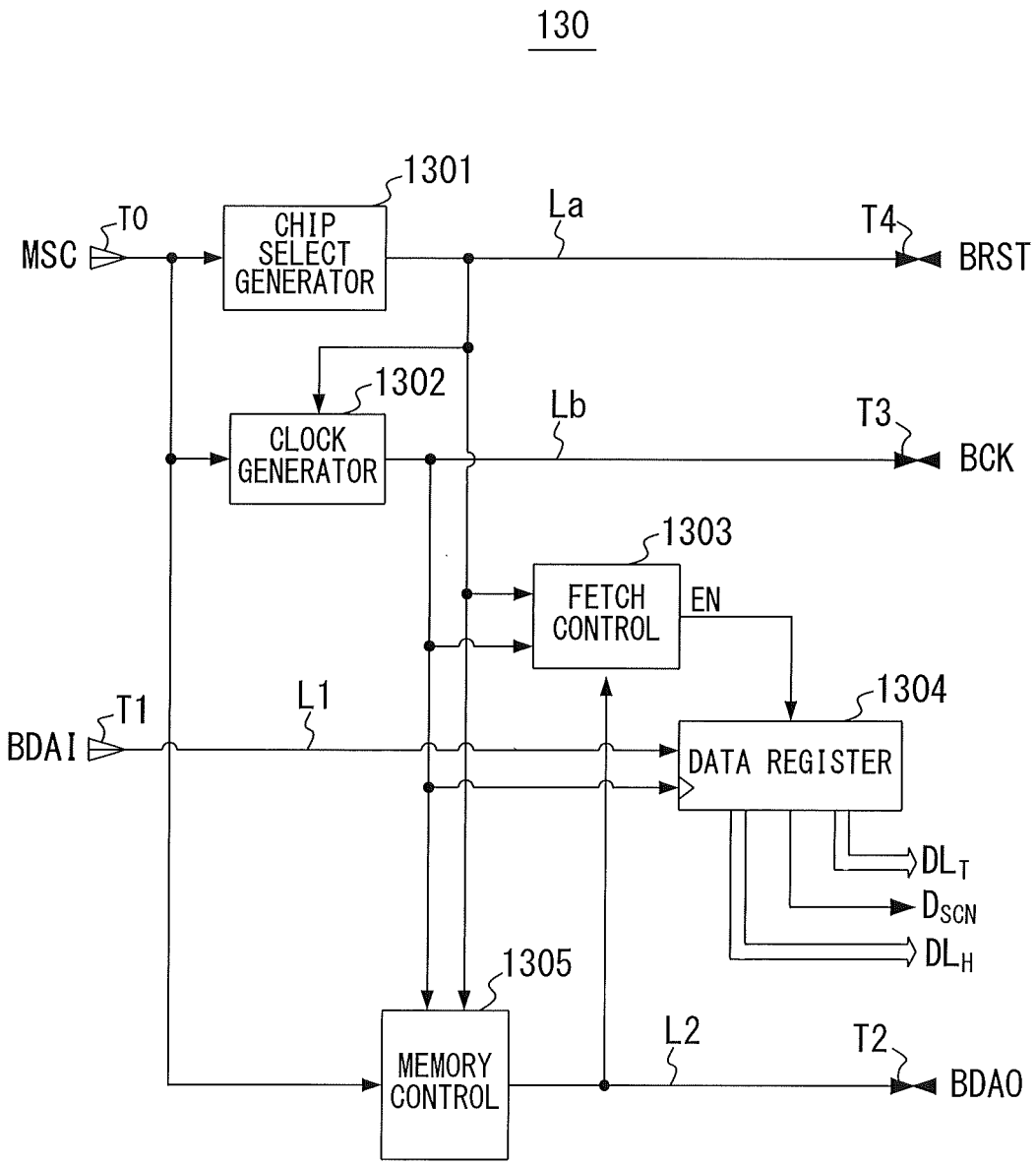
FIG. 5 is a block diagram of an internal configuration of a setting data acquisition control unit shown in FIG. 2.

FIG. 5 shows a block diagram of an internal configuration of the setting data acquisition control unit 130.

As depicted in FIG. 5, the setting data acquisition control unit 130 includes a chip select generation circuit 1301, a clock generation circuit 1302, a fetch control circuit 1303, a data register 1304, and a memory control circuit 1305.

Figure 6:
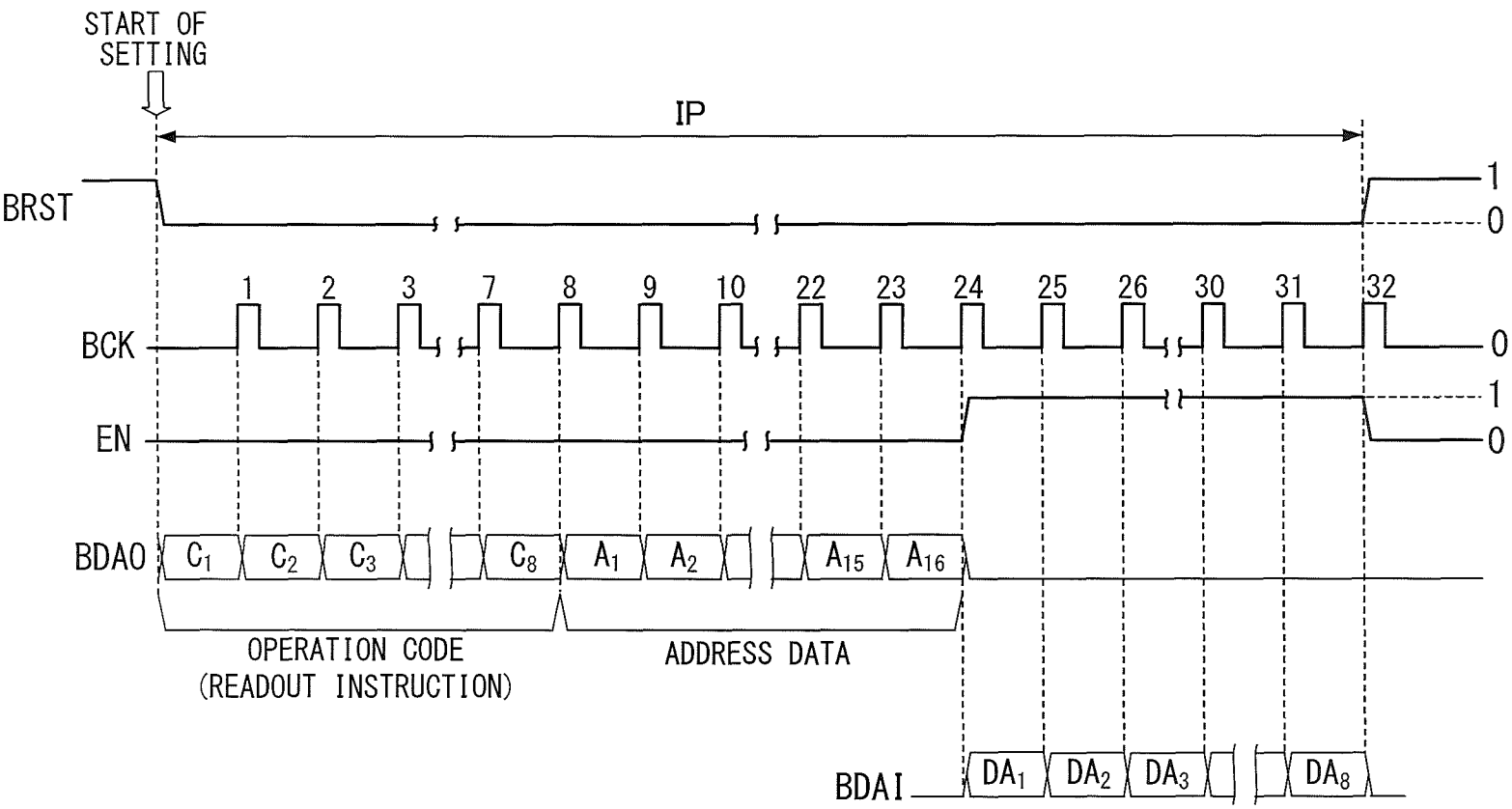
FIG. 6 is a time chart of a fetch operation of the setting data from a setting data memory.

If the master/slave specifying signal MSC is at the logic level 1 indicative of "master," the chip select generation circuit 1301 generates a chip select signal BRST, which is at the logic level 0 only during a period IP, from predetermined timing after power-on, i.e., the timing of start of setting as depicted in FIG. 6, and outputs the chip select signal BRST via a line La and the bidirectional terminal T4 to the outside of the chip. The chip select generation circuit 1301 supplies the chip select signal BRST via the line La also to each of the clock generation circuit 1302, the fetch control circuit 1303, and the memory control circuit 1305. If the master/slave specifying signal MSC is at the logic level 0 indicative of "slave," then the chip select generation circuit 1301 does not generate the chip select signal BRST and causes the line La and the bidirectional terminal T4 to operate as an input terminal.

Only if the master/slave specifying signal MSC is at the logic level 1 indicative of "master," the clock generation circuit 1302 generates the clock signal BCK including 32 clock pulses as depicted in FIG. 6 while the chip select signal BRST received via the line La is at the logic level 0. The clock generation circuit 1302 then outputs the clock signal BCK via a line Lb and the bidirectional terminal T3 to the outside of the chip. The clock generation circuit 1302 supplies the clock signal BCK via the line Lb also to each of the fetch control circuit 1303, the data register 1304, and the memory control circuit 1305. If the master/slave specifying signal MSC is at the logic level 0 indicative of "slave," the clock generation circuit 1302 does not generate the clock signal BCK and causes the line Lb and the bidirectional terminal T3 to operate as an input terminal.

If the chip select signal BRST shifts from the logic level 1 to the logic level 0, the fetch control circuit 1303 determines whether operation codes $C_1$ to $C_8$ (described later) included in the memory access signal BDAO indicate a readout instruction. Only when the operation codes indicate the readout instruction, the fetch control circuit 1303 supplies to the data register 1304 a fetch enable signal EN that shifts from the logic level 0 to the logic level 1 when the number of the clock pulses generated by the clock signal BCK reaches twenty-four and that maintains this state (i.e., logic level 1) for a period of eight clock pulses, as shown in FIG. 6. On the other hand, if it is determined that the operation codes $C_1$ to $C_7$ do not indicate the readout instruction, the fetch control circuit 1303 supplies a fetch enable signal EN maintaining the logic level 0 to the data register 1304. It should be noted that the chip select signal BRST shifting from the logic level 1 to the logic level 0 may always be used for a readout instruction, and if so, the fetch enable signal EN may be generated upon detecting the logic level 0 of the chip select signal BRST without input of the memory access signal BDAO.

While the fetch enable signal EN is at the logic level 1, the data register 1304 receives the setting data signal BDAI in serial form, which has been read from the setting data memory 14, via the input terminal T1 and a line L1 and sequentially fetches the setting data signal BDAI in synchronization with the clock signal BCK. The data register 1304 supplies the head latch specifying data $DL_H$, the tail latch specifying data $DL_T$, and the scan direction specifying data $D_{SCN}$ included in the fetched setting data signal BDAI to the latch selection counter 131. The above-mentioned predetermined timing after the power-on, i.e., opportunity of the setting operation for reflecting the setting data ($DL_H$, $DL_T$, and $DL_{SCN}$) stored in the setting data memory 14 on the data register 1304, occurs at least once within a predetermined period after power supply start-up. The setting operation may repeatedly be performed at predetermined intervals (e.g., once per second) after power-up. In each case, the setting operation is preferably performed after a power source attains a stable state after power supply start-up.

When the master/slave specifying signal MSC is at the logic level 1 indicative of "master" and the chip select signal BRST shifts from the logic level 1 to the logic level 0, then the memory control circuit 1305 sends onto the line L2 the memory access signal BDAO including the operation codes $C_1$ to $C_8$, which represent the readout instruction in 8-bit serial form, as depicted in FIG. 6. Subsequently, the memory control circuit 1305 sends onto the line L2 the memory access signal BDAO including address data $A_1$ to $A_{16}$, which represent the address at which the setting data ($DL_H$, $DL_T$, and $DL_{SCN}$) is stored in the setting data memory 14 in 16-bit serial form. The memory control circuit 1305 supplies the memory access signal BDAO via the line L2 to the fetch control circuit 1303 while outputting the memory access signal BDAO via the bidirectional terminal T2 to the outside of the chip. When the master/slave specifying signal MSC is at the logic level 0 indicative of "slave," the memory control circuit 1305 does not send the memory access signal BDAO and causes the line L2 and the bidirectional terminal T2 to operate as an input terminal.

Figure 7:
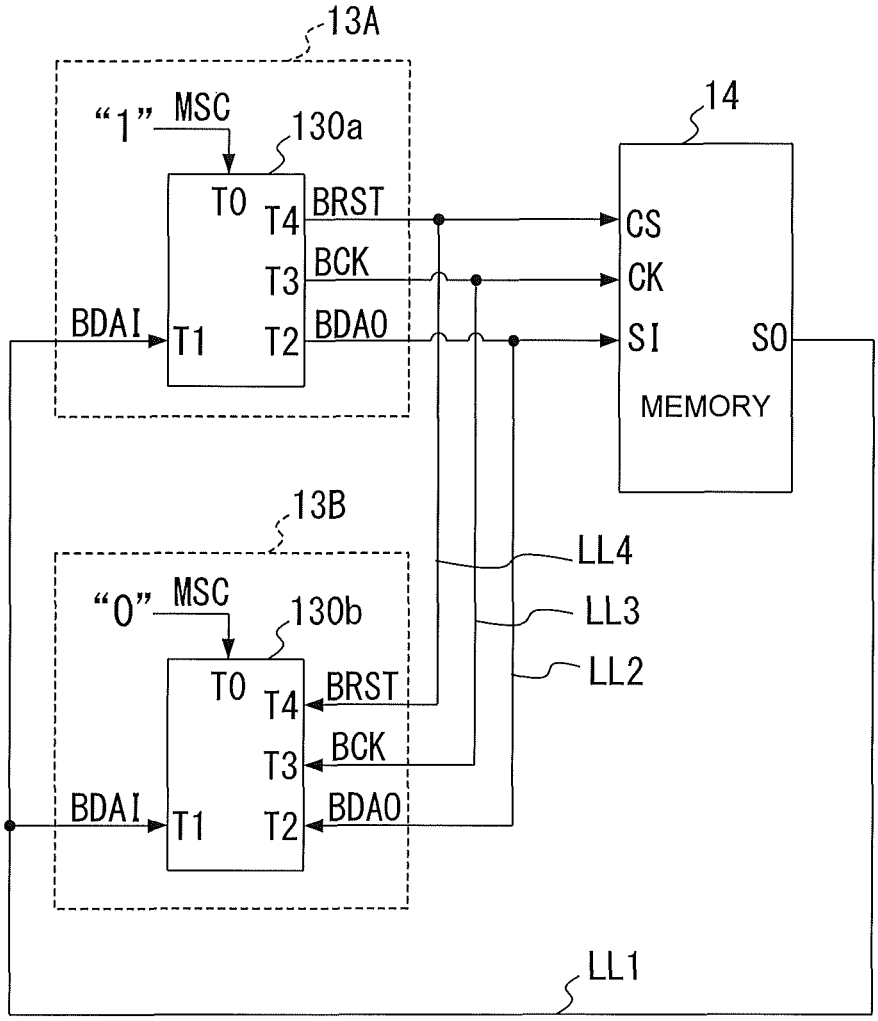
FIG. 7 is a diagram of connection between the source drivers and the setting data memory.

FIG. 7 illustrates connections among the first setting data acquisition control unit 130*a* in the first source driver 13A, the setting data memory 14, and the second setting data acquisition control unit 130*b* in the second source driver 13B.

In the example depicted in FIG. 7, the first setting data acquisition control unit 130*a* of the first source driver 13A is supplied with the master/slave specifying signal MSC of the logic level 1 indicative of "master," and the second setting data acquisition control unit 130*b* of the second source driver 13B is supplied with the master/slave specifying signal MSC of the logic level 0 indicative of "slave." Therefore, the first source driver 13A acts as the master driver for fetching the setting data and the second source driver 13B acts as the slave driver. As such, the chip select generation circuit 1301, the clock generation circuit 1302, and the memory control circuit 1305 in the first setting data acquisition control unit 130*a* perform the above-described operations whereas the chip select generation circuit 1301, the clock generation circuit 1302, and the memory control circuit 1305 in the second setting data acquisition control unit 130*b* is brought into a deactivated condition.

As depicted in FIG. 7, the input terminals T1 responsible for input of the setting data signal BDAI in the two source drivers 13A and 13B are both connected through a line LL1 to a serial output terminal SO of the setting data memory 14. The bidirectional terminals T2 responsible for input/output of the memory access signal BDAO in the source drivers 13A and 13B are both connected through a line LL2 to a serial input terminal SI of the setting data memory 14. The bidirectional terminals T3 responsible for input/output of the clock signal BCK in the source drivers 13A and 13B are both connected through a line LL3 to a clock terminal CK of the setting data memory 14. The bidirectional terminals T4 responsible for input/output of the chip select signal BRST in the source drivers 13A and 13B are both connected through a line LL4 to a chip select terminal CS of the setting data memory 14.

When a process of reflecting the data in the setting data memory 14 on the date register 1304 starts, the setting data acquisition control unit 130*a* of the first source driver 13A supplies the chip select signal BRST and the clock signal BCK (FIG. 6) to the setting data acquisition control unit 130*b* of the second source driver 13B and the setting data memory 14. The setting data acquisition control unit 130*a* also supplies the memory access signal BDAO including the operation codes $C_1$ to $C_8$ and the address data $A_1$ to $A_{16}$ (FIG. 6) indicative of the readout instruction to the setting data acquisition control unit 130*b* of the second source driver 13B and the setting data memory 14. Thus, the setting data memory 14 reads the setting data ($DL_H$, $DL_T$, and $DL_{SCN}$) stored at the address(es) indicted by the address data $A_1$ to $A_{16}$. The setting data memory 14 supplies the setting data signal BDAI including the data $DA_1$ to $DA_8$ (FIG. 6) indicative of the setting data ($DL_H$, $DL_T$, and $DL_{SCN}$) in serial form to the setting data acquisition control units 130*a* and 130*b* of the source drivers 13A and 13B.

In the meantime, the chip select signal BRST generated by the setting data acquisition control unit 130*a* is introduced to the fetch control circuit 1303 of the setting data acquisition control unit 130*a* and is supplied via the bidirectional terminal T4 and the line La of the source driver 13B to the fetch control circuit 1303 of the setting data acquisition control unit 130*b*. The clock signal BCK generated by the setting data acquisition control unit 130*a* is introduced to the fetch control circuit 1303 of the setting data acquisition control unit 130*a* and is supplied via the bidirectional terminal T3 of the source driver 13B to the fetch control circuit 1303 of the setting data acquisition control unit 130*b*.

As a result, the fetch control circuits 1303 of the two setting data acquisition control units 130*a* and 130*b* supply the fetch enable signal EN of the logic level 1 (FIG. 6) to the data registers 1304. In response to the fetch enable signal EN, the data registers 1304 of the setting data acquisition control units 130*a* and 130*b* fetch and store the setting data signal BDAI, which as been read from the setting data memory 14, as depicted in FIG. 6. In other words, the head latch specifying data $DL_H$, the tail latch specifying data $DL_T$, and the scan direction specifying data $D_{SCN}$ indicated by the setting data signal BDAI are fetched at the same time by the data registers 1304 in the two setting data acquisition control units 130*a* and 130*b*.

Accordingly, the setting data ($DL_H$, $DL_T$, and $DL_{SCN}$) stored in the setting data memory 14 is possessed at the same time by the data registers 1304 in the two source drivers 13A and 13B, and the setting is carried out in accordance with the setting data. In the first setting after power-on, predetermined initial setting data is fetched by the data registers 1304.

It should be noted that the memory control circuit 1305 of the setting data acquisition control unit 130*a* may perform the write control for writing the setting data to the setting data memory 14 in addition to the above-described read control for reading the setting data ($DL_H$, $DL_T$, and $DL_{SCN}$) from the setting data memory 14.

Figure 8:
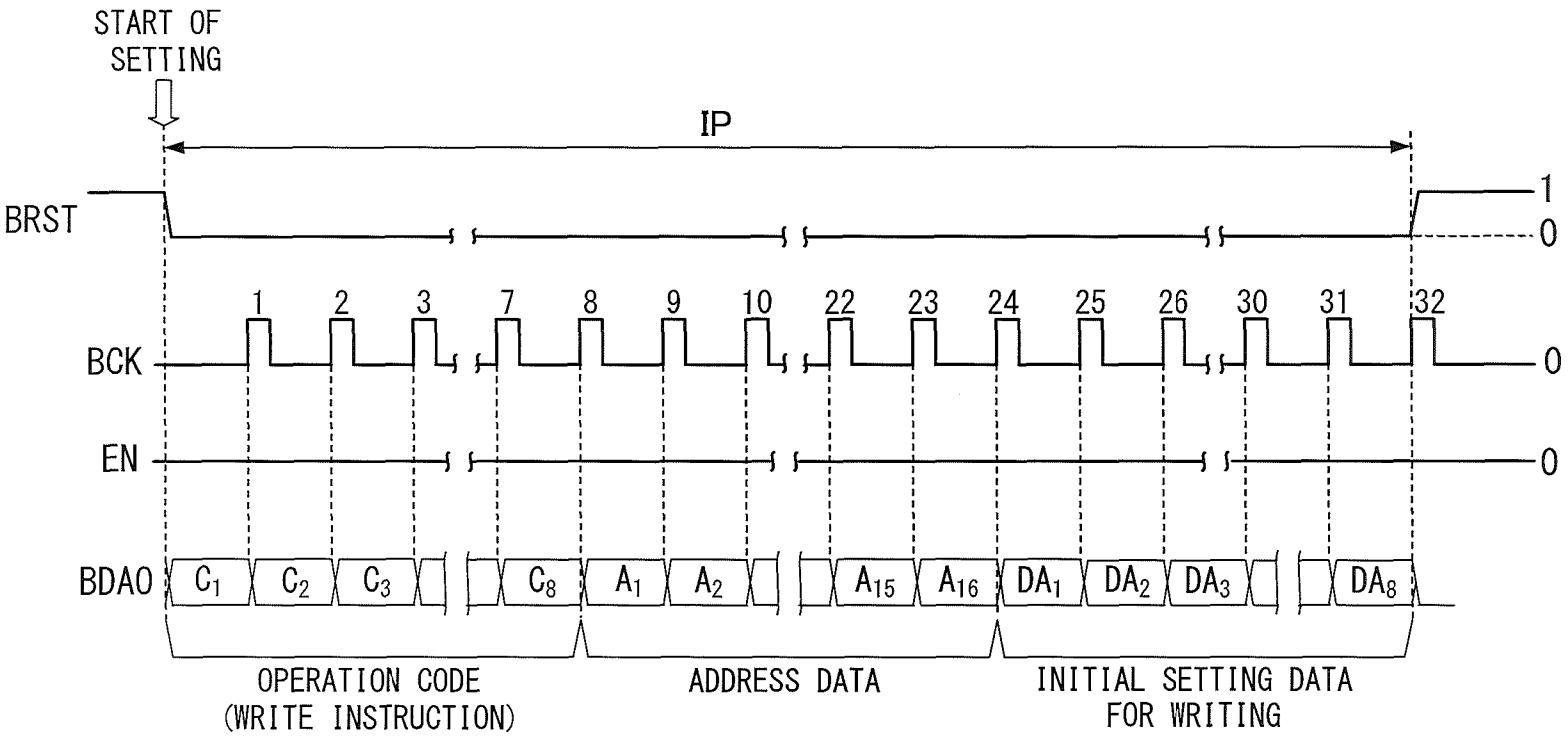
FIG. 8 is a time chart of a writing operation of the setting data to the setting data memory.

If the setting data is written into the setting data memory 14, the chip select generation circuit 1301 and the clock generation circuit 1302 of the setting data acquisition control unit 130*a* generate and supply the chip select signal BRST and the clock signal BCK as depicted in FIG. 8 to the setting data acquisition control unit 130*b* and the setting data memory 14. The memory control circuit 1305 of the setting data acquisition control unit 130*a* supplies the memory access signal BDAO including operation codes $C_1$ to $C_8$ indicative of a write instruction, address data $A_1$ to $A_{16}$ indicative of a write address, and data $DB_1$ to $DB_8$ representative of setting data ($DL_H$, $DL_T$, and $DL_{SCN}$) for writing as depicted in FIG. 8 to the setting data memory 14 and the source driver 13B. In response to this memory access signal BDAO, the setting data memory 14 writes the data $DB_1$ to $DB_8$ representative of the setting data ($DL_H$, $DL_T$, and $DL_{SCN}$) for writing at the address(es) indicated by the address data $A_1$ to $A_{16}$.

This memory access signal BDAO is supplied via the line L2 to the fetch control circuit 1303 of the first setting data acquisition control unit 130*a* and is also supplied via the bidirectional terminal T2 to the fetch control circuit 1303 of the second setting data acquisition control unit 130*b*. Therefore, although the chip select signal BRST and the clock signal BCK as depicted in FIG. 8 are supplied, the fetch control circuit 1303 supplies a fetch enable signal EN of the logic level 0 indicative of write disable to the data register 1304 because the operation codes $C_1$ to $C_8$ included in the memory access signal BDAO indicate the write instruction.

As a result, when data is written into the setting data memory 14, the data registers 1304 of the two setting data acquisition control units 130*a* and 130*b* are prevented from malfunctioning, i.e., the data registers 3104 would not fetch data. It should be noted, however, that if the setting data should immediately be reflected on the slave driver, the fetch control circuit 1303 of the second setting data acquisition control unit 130*b* may shift the fetch enable signal EN to the logic level 1 for both reading and writing.

The present invention is not limited to the illustrated and described embodiments. For example, although a plurality of the source lines S formed on the display panel 10 is divided into two line groups ($S_1$ to $S_m$ and $S_{m+1}$ to $S_{2m}$) and the two line groups are driven by the two source drivers 13A and 13B respectively in the above-described embodiment, the number of the source drivers 13 is not limited to two and may be three or more. If there are t source drivers (t is an integer greater than two), one of the t source drivers is used as a master driver and other source drivers are used as slave drivers. Thus, the respective master/slave specifying signals MSC are supplied to the t source drivers in advance to set one of the t source drivers as the master driver and all the remaining source drivers as the slave drivers.

In the setting method of a display panel driver according to the present invention for setting a plurality of the display panel drivers (13A and 13B) to conditions in conformity to given specifications, the setting data ($DL_H$, $DL_T$, and $DL_{SCN}$) based on the specifications is stored in the memory 14. One of the display panel drivers (13A) supplies a first signal (the memory access signal BDAO or the chip select signal BRST) indicating that the setting data is in a readout condition to the memory and other display panel driver(s) (13B). In response to the first signal (BDAO, BRST), the memory 14 reads the setting data and sends it onto the first line (LL1). Said one display panel driver (13A) fetches the setting data on the first line (1303, 1304) to perform the setting based on the setting data. On the other hand, the other display panel drivers (13B) fetch the setting data from the first line (1303, 1304) in response to the first signal (BDAO, BRST) received from said one display panel driver (13A) to perform the setting based on the setting data.

A display panel driver (13A, 13B) according to the present invention has the memory control circuit 1305 for sending via the bidirectional terminal T2 the first signal (BDAO, BRST) indicating that the setting data ($DL_H$, $DL_T$, and $DL_{SCN}$) stored in the memory 14 is in the readout condition. The display panel driver also includes the fetch control circuit 1303 for generating the fetch enable signal EN in response to the first signal or a first-signal-equivalent signal received from the outside via the bidirectional terminal T2. The display panel driver also includes the register 1304 for fetching the setting data, which has been read from the memory 14, in response to the fetch enable signal.

A display apparatus 9 according to the present invention has the display panel 10 configured to display an image corresponding to an input video signal, display panel drivers (13A and 13B) configured to drive the display panel 10, and the memory 14 configured to store the setting data ($DL_H$, $DL_T$, and $DL_{SCN}$). Each of the display panel drivers has the memory control circuit 1305, the fetch control circuit 1303, and the register 1304. The output terminal SO of the memory 14 is connected through the first line LL1 to the input terminals T1 of the respective display panel drivers. The bidirectional terminals T2 of the respective display panel drivers and the memory 14 are connected to each other through the second line LL2.

With the configuration, in response to the first signal (BDAO, BRST) issued from the above-mentioned one display panel driver (13A), the setting data ($DL_H$, $DL_T$, and $DL_{SCN}$) is read from the memory 14 and provided on the first line LL1. Then, this display panel driver (13A) and the other display panel drivers (13B) concurrently fetch the setting data on the first line.

Therefore, according to the present invention, the setting operation can quickly be finished as compared to those that sequentially relay and supply the setting data from the memory to display panel drivers connected in series via cascaded wiring.

This application is based on Japanese Patent Application No. 2012-236861 filed on Oct. 26, 2012, and the entire disclosure thereof is incorporated herein by reference.

What is claimed is:

1. A display panel driver setting method for setting a plurality of display panel drivers in accordance with specifications based on a drive condition setting data stored in and read out from a memory, said plurality of display panel drivers being configured to drive a single display panel that displays an image corresponding to a video signal, said method comprising:

causing one of said plurality of display panel drivers to supply a first signal indicating that said drive condition setting data becomes a readout condition to said memory and to remaining ones of the display panel drivers:

causing said one display panel driver to fetch said drive condition setting data, which is read from said memory through a common data line, to perform setting based on said drive condition setting data; and causing said remaining ones of said plurality of display panel drivers to fetch said drive condition setting data all at once from said common data line in response to said first signal supplied from said one display panel driver to perform said setting based on said drive condition setting data.

2. The display panel driver setting method of claim 1, wherein the first signal is a chip select signal.

3. The display panel driver setting method of claim 1, wherein the first signal is a memory access signal.

4. The display panel driver setting method of claim 1, wherein the setting is performed in a predetermined period after power supply start-up.

5. The display panel driver setting method of claim 1, wherein the setting is periodically performed after power supply start-up.

6. The display panel driver setting method of claim 3, wherein the memory, said one display panel driver, and said remaining ones of the display panel drivers are connected to the common data line.

7. The display panel driver setting method of claim 6, wherein the memory, said one display panel driver, and the other display panel driver are further connected to a second line different from the common data line, and said one display panel driver supplies the memory access signal through the second line to the memory and said remaining ones of the display panel drivers.

8. A display panel driver configured to be set in accordance with a drive condition setting data stored in and read out from a memory, comprising:

a first circuit for generating, in response to an externally-supplied master/slave specifying signal, a memory access signal indicating that said drive condition setting data becomes a condition to be read and for outputting via a bidirectional terminal to the memory;

a fetch control circuit for generating a fetch enable signal in response to the memory access signal or a first-signal-equivalent external signal received from the outside via the bidirectional terminal; and a register for fetching said drive condition setting data, which is read from the memory, in response to the fetch enable signal.

9. The display panel driver of claim 8, wherein the first circuit is a setting data acquisition control unit including a chip select generation circuit for generating a chip select signal.

10. The display panel driver of claim 9, wherein the setting data acquisition control unit includes a memory control circuit for generating the memory access signal.

11. The display panel driver of claim 10, wherein if an externally supplied master/slave specifying signal indicates a master, then the memory control circuit outputs the memory access signal via a bidirectional terminal, and if the master/slave specifying signal indicates a slave, then the memory control circuit does not generate the memory access signal and uses the bidirectional terminal as an input terminal.

12. The display panel driver of claim 10, wherein if the drive condition setting data is written into the memory, the memory control circuit generates a memory access signal indicative of a write instruction, and if the memory control circuit generates the memory access signal indicative of the write instruction or if the memory access signal received from outside via the bidirectional terminal indicates the write instruction, then the fetch control circuit terminates generation of the fetch enable signal.

13. The display panel driver of claim 11, wherein the memory control circuit generates the memory access signal at predetermined timing only if the externally supplied master/slave specifying signal indicates the master.

14. A display apparatus comprising:

a display panel configured to display an image corresponding to a video signal;

a first display panel driver and a second display panel driver configured to drive in combination the display panel; and a memory configured to store a drive condition setting data, the first display panel driver including:

a first circuit for generating and outputting, in response to an externally-supplied master/slave specifying signal, a memory access signal indicating that the drive condition setting data is in a condition to be read via a bidirectional terminal to the memory;

a first fetch control circuit for generating a fetch enable signal in response to the memory access signal; and a first register for receiving via an input terminal the drive condition setting data which is read from the memory, the first register fetching the drive condition setting data in response to the fetch enable signal, the second display panel driver including:

a second fetch control circuit for generating a fetch enable signal in response to the memory access signal externally received at a second bidirectional terminal via the first bidirectional terminal; and a second register for receiving via an input terminal the drive condition setting data which is read from the memory, the second register fetching the drive condition setting data in response to the fetch enable signal, an output terminal of the memory being connected through a first line to the input terminals of the first and second display panel drivers, the first bidirectional terminal of the first display panel driver being connected through a second line to the memory and to the second bidirectional terminal of the second display panel driver.

15. The display apparatus of claim 14, wherein the first circuit is a setting data acquisition control unit including a chip select generation circuit for generating a chip select signal.

16. The display apparatus of claim 15, wherein the first circuit is the setting data acquisition control unit including a memory control circuit for generating the memory access signal.

17. The display apparatus of claim 16, wherein if an externally supplied master/slave specifying signal indicates a master, then the memory control circuit outputs the memory access signal via a bidirectional terminal, and if the master/slave specifying signal indicates a slave, then the memory control circuit does not generate the memory access signal and uses the bidirectional terminal as an input terminal.

18. The display apparatus of claim 17, wherein one of the first and second display panel drivers is externally supplied with the master/slave specifying signal indicative of the master, and the other of the first and second display panel drivers is externally supplied with the master/slave specifying signal indicative of the slave.

19. The display apparatus of claim 18, wherein if the drive condition setting data is written into the memory, the memory control circuit of said one display panel driver generates a memory access signal indicative of a write instruction, and if the memory control circuit generates the memory access signal indicative of the write instruction or if the memory access signal externally received via the bidirectional terminal indicates the write instruction, then the fetch control circuit terminates generation of the fetch enable signal.

20. The display apparatus of claim 16, wherein the memory control circuit of said one display panel driver generates the memory access signal at predetermined timing after power-on.

* * * * *